US006982674B2

(12) United States Patent
Matsubara et al.

(10) Patent No.: US 6,982,674 B2
(45) Date of Patent: Jan. 3, 2006

(54) ANTENNA APPARATUS

(75) Inventors: Hiroyuki Matsubara, Tokyo (JP); Shinobu Izumi, Saitama (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 10/816,136

(22) Filed: Apr. 1, 2004

(65) Prior Publication Data

US 2004/0252060 A1 Dec. 16, 2004

(30) Foreign Application Priority Data

Apr. 4, 2003 (JP) ..... 2003-101165

(51) Int. Cl.
*H01Q 1/38* (2006.01)

(52) U.S. Cl. ..... 343/700 MS; 343/725

(58) Field of Classification Search ..... 343/700 MS, 343/725, 893

See application file for complete search history.

(56) References Cited

U.S. PATENT DOCUMENTS 5,754,145 A * 5/1998 Evans ..... 343/795
6,298,243 B1 * 10/2001 Basile ..... 455/552.1
6,731,904 B1 * 5/2004 Judd ..... 455/11.1
6,825,803 B2 * 11/2004 Wixforth et al. ..... 342/357.1
2003/0201939 A1 * 10/2003 Reece et al. ..... 343/700 MS

* cited by examiner

*Primary Examiner*—Shih-Chao Chen
(74) *Attorney, Agent, or Firm*—Frommer Lawrence & Haug LLP; William S. Frommer; Darren M. Simon

(57) ABSTRACT

An antenna apparatus of the present invention includes a first circularly polarized antenna for a first frequency band, a second circularly polarized antenna for a second frequency band, and a substrate that is common to these two antennas. The antennas are disposed back to back on the front and rear surfaces of the substrate. High-frequency signals in the first frequency band and the second frequency band that are sent and received by the first circularly polarized antenna and the second circularly polarized antenna, respectively, are connected, via a common frequency synthesizer and a common coaxial cable, to an antenna connector of a wireless communication apparatus.

7 Claims, 11 Drawing Sheets

ANTENNA APPARATUS

BACKGROUND OF THE INVENTION

1. Field of the Invention

The present invention relates to circularly polarized antenna apparatuses suitable for a variety of wireless communication systems using two different frequency bands.

2. Description of the Related Art

Wireless communication systems using 2.4 and 5.2 GHz wireless local area networks (LANs) are used these days to transmit various types of audiovisual (AV) data including television (TV) pictures.

To successfully receive such AV data, a communication error rate in wireless transmission needs to be minimized. Since communication errors become apparent on the screen in the forms of block noises and stops of moving images, the requirement for minimizing the communication errors in transmitting AV data is higher than that in general wireless data transmission such as transmission over the Internet.

In wireless transmission of AV data, therefore, circularly polarized antennas are used to minimize the communication error rate. The reasons for use include circularly polarized waves being resistant to multipath interference and being not dependent on the antenna orientation.

First, the reason for the circularly polarized waves being resistant to multipath interference will be described.

When a single type of linearly polarized waves are used, the waves cancel each other out due to reflection from obstructions, resulting in a plurality of dead spots.

On the other hand, when the circularly polarized waves are used and reflected by obstructions, the traveling direction instead of the rotational direction is reversed. In other words, with respect to the traveling direction, the rotational direction of the circularly polarized waves is reversed, and thus, multipath interference caused by reflected waves is minimized. Therefore, the circularly polarized waves are more resistant to multipath interference compared to the linearly polarized waves.

Next, the reason for the circularly polarized waves not being dependent on the antenna orientation will be described.

When a single type of linearly polarized waves are used and antennas of a transmitter and receiver are different in orientation, the communication error rate increases due to a reduced gain.

On the other hand, when the circularly polarized waves are used, the communication error rate remains substantially unchanged regardless of the changes in antenna orientation, since a gain remains unchanged even though antennas of a transmitter and receiver rotate about the traveling direction.

Examples of known circularly polarized antennas include single band antennas designed for 2.4 GHz and 5.2 GHz, but no circularly polarized antenna for dual band exists.

Therefore, two independent circularly polarized antennas are required, as shown in FIG. 3, for use in dual-band wireless communication units.

The following describes the circularly polarized antennas in FIG. 3.

FIG. 3 illustrates a circularly polarized antenna A 301 for a first frequency band and a circularly polarized antenna B 302 for a second frequency band.

A flat antenna 301*b* is disposed on a dielectric plate 301*a* to form the circularly polarized antenna A 301, which is disposed on a surface of a substrate 303. The flat antenna 301*b* is connected via a wiring pattern on the surface of the substrate 303 to a coaxial cable 305.

Similarly, a flat antenna 302*b* is disposed on a dielectric plate 302*a* to form the circularly polarized antenna B 302, which is disposed on a surface of a substrate 304. The flat antenna 302*b* is connected via a wiring pattern on the surface of the substrate 304 to a coaxial cable 306.

The circularly polarized antennas A 301 and B 302, which are different in size and frequency band characteristics, have hemispherical radiation patterns and are disposed such that their waves are opposite in direction.

Furthermore, to provide a diversity antenna apparatus using the above-described circularly polarized antennas, at least two antennas are required for each of two frequency bands, that is, a total of four or more independent antennas need to be mounted on the dual-band wireless communication unit (see, for example, Japanese Unexamined Patent Application Publication No. 2002-43994).

In a known circularly polarized antenna, as described above, a combination of two single-band antennas is required for providing a dual-band antenna apparatus, and further, a combination of four single-band antennas is required for providing a diversity antenna apparatus. This interferes with the reduction in size of the wireless communication unit.

Moreover, when coaxial cables connected to antennas are mounted on the wireless communication unit, the coaxial cables function as antennas and might emit and detect noises to and from the wireless communication unit and other peripheral devices. The noises caused by the coaxial cables seriously affect the dual-band wireless communication unit, which requires four coaxial cables.

SUMMARY OF THE INVENTION

Accordingly, an object of the present invention is to provide an antenna apparatus that can reduce the size of a wireless communication unit incorporating the apparatus by combining circularly polarized antennas for a plurality of frequency bands. Another object is to provide an antenna apparatus that can reduce noises by reducing the number and length of the coaxial cables.

To achieve the above-described objectives, the antenna apparatus of the present invention includes a first circularly polarized antenna, a second circularly polarized antenna, and a substrate having these two antennas on both the front and rear surfaces. The first circularly polarized antenna and the second circularly polarized antenna, which are oriented in the opposite direction, efficiently radiate high-frequency signals in a first frequency band and a second frequency band, respectively, in substantially hemispherical shapes.

In the antenna apparatus of the present invention, the first and second circularly polarized antennas for different frequency bands are disposed on the front and rear surfaces of the same substrate. Since two circularly polarized antennas are combined together, the size of the entire wireless communication unit can be reduced.

Moreover, the first and second circularly polarized antennas are connected, via wiring patterns on the substrate and via a common frequency synthesizer, to a common coaxial cable. The number and length of the coaxial cable are thus reduced, and noise reduction and ease of wiring can be achieved.

DESCRIPTION OF THE PREFERRED EMBODIMENTS

Embodiments of an antenna apparatus according to the present invention will now be described.

Figure 1:
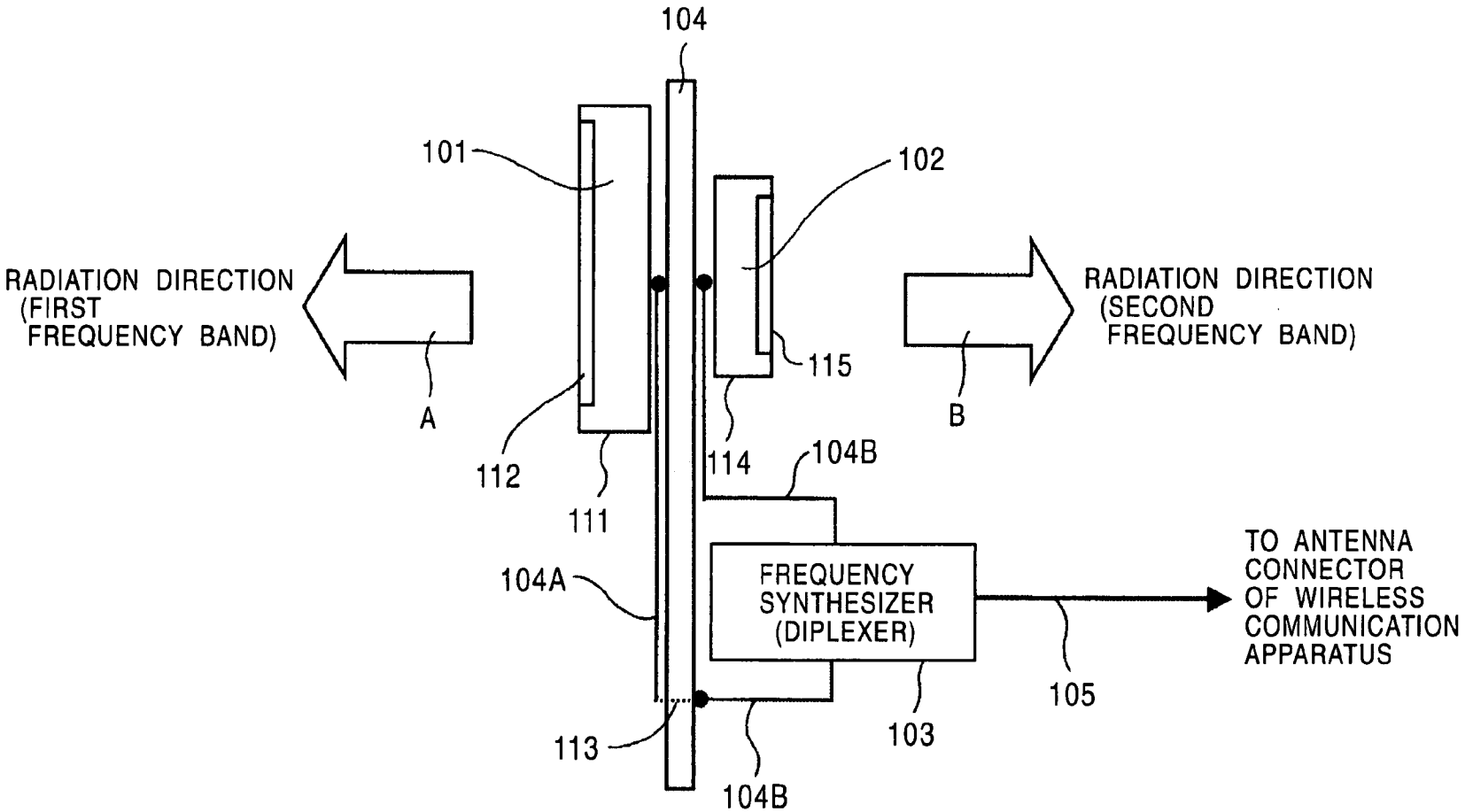
FIG. 1 is a side view of a dual-band circularly polarized antenna apparatus according to a first embodiment of the present invention.

FIG. 1 is a side view of an antenna apparatus according to a first embodiment of the present invention.

The antenna apparatus of this embodiment includes a circularly polarized antenna A 101 that efficiently radiates high-frequency signals in a first frequency band in a substantially hemispherical shape, a circularly polarized antenna B 102 that efficiently radiates high-frequency signals in a second frequency band in a substantially hemispherical shape, and a substrate 104 that is common to these two antennas. The circularly polarized antennas A 101 and B 102 are arranged back to back on the front and rear surfaces of the substrate 104.

The circularly polarized antennas A 101 and B 102, which are different in size and frequency band, have hemispherical radiation patterns and radiate radio waves in the opposite direction as indicated by arrows A and B in FIG. 1.

A flat antenna A 112 is disposed on a dielectric plate A 111 to form the circularly polarized antenna A 101, which is disposed on the front surface of the substrate 104. A wiring pattern 104A, which is provided on the front surface of the substrate 104 and is connected to the flat antenna A 112, then leads to the lower end of the substrate 104, further to the rear surface via a through hole 113 of the substrate 104, and is connected to a frequency synthesizer (diplexer) 103 via a wiring pattern 104B on the rear surface.

Similarly, a flat antenna B 115 is disposed on a dielectric plate B 114 to form the circularly polarized antenna B 102, which is disposed on the rear surface of the substrate 104. A wiring pattern 104B, which is provided on the rear surface of the substrate 104 and is connected to the flat antenna B 115, then leads to the lower end of the substrate 104, and is connected to the frequency synthesizer (diplexer) 103.

High-frequency signals in the first frequency band and the second frequency band received at the circularly polarized antenna A 101 and the circularly polarized antenna B 102, respectively, are output, via the frequency synthesizer 103 and a coaxial cable 105, to an antenna connector of a wireless communication apparatus, which is described below. High-frequency signals transmitted from the wireless communication apparatus pass through the coaxial cable 105 and the frequency synthesizer 103 and are output to the circularly polarized antenna A 101 or B 102 depending on whether the signals are in the first or second frequency band.

As described above, the use of the frequency synthesizer 103 reduces the number of coaxial cables 105 connected to the wireless communication apparatus, from two to one.

In the first embodiment, the frequency synthesizer 103 synthesizes the high-frequency signals from the circularly polarized antenna A 101 or B 102 to be provided to the coaxial cable 105, or separates the signals from the coaxial cable 105 to be provided to the circularly polarized antenna A 101 or B 102. However, the frequency synthesizer may be removed and each of the two circularly polarized antennas may be provided with a coaxial cable, instead.

Figure 2:
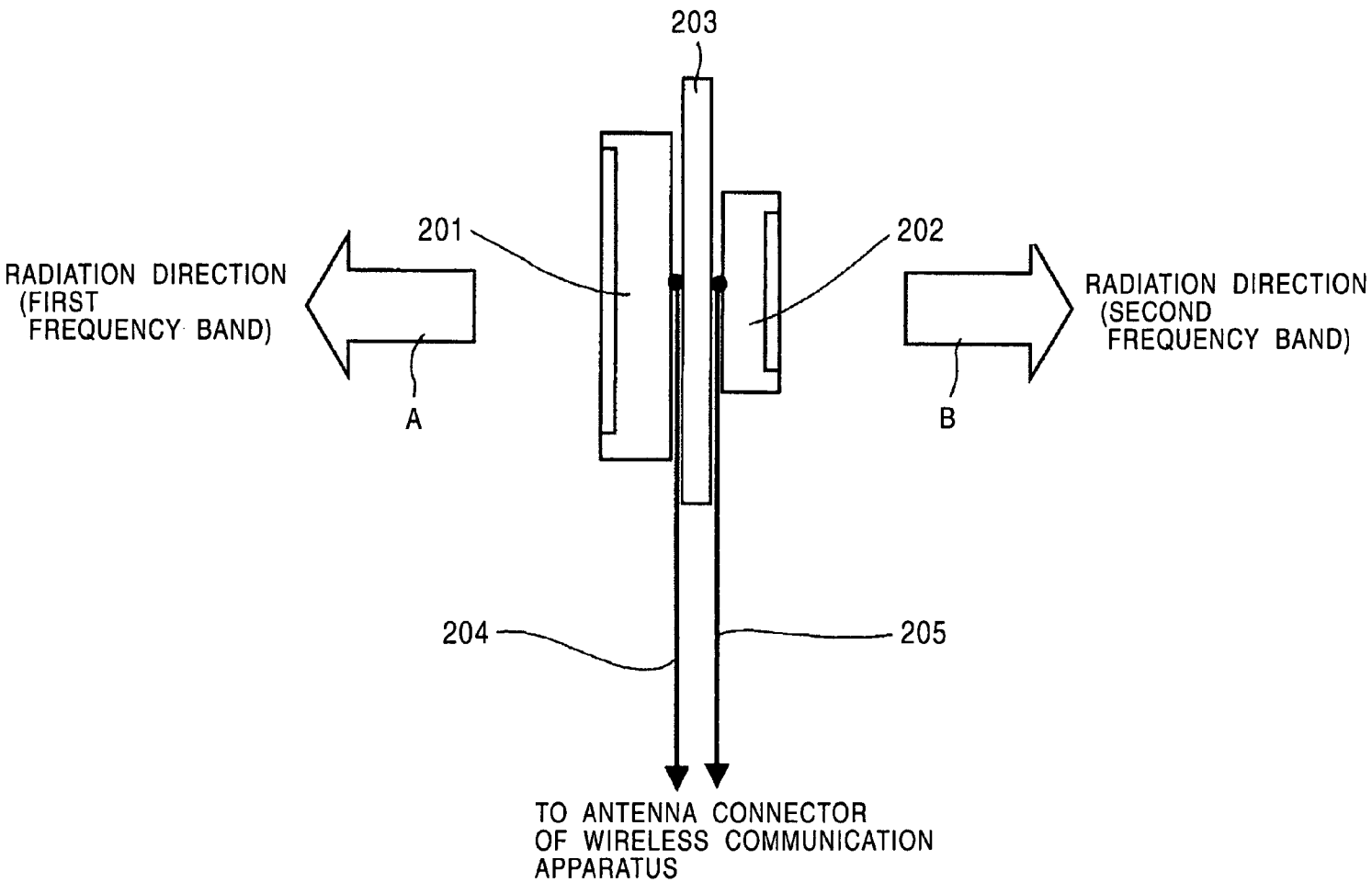
FIG. 2 is a side view of a dual-band circularly polarized antenna apparatus according to a second embodiment of the present invention.
Figure 3:
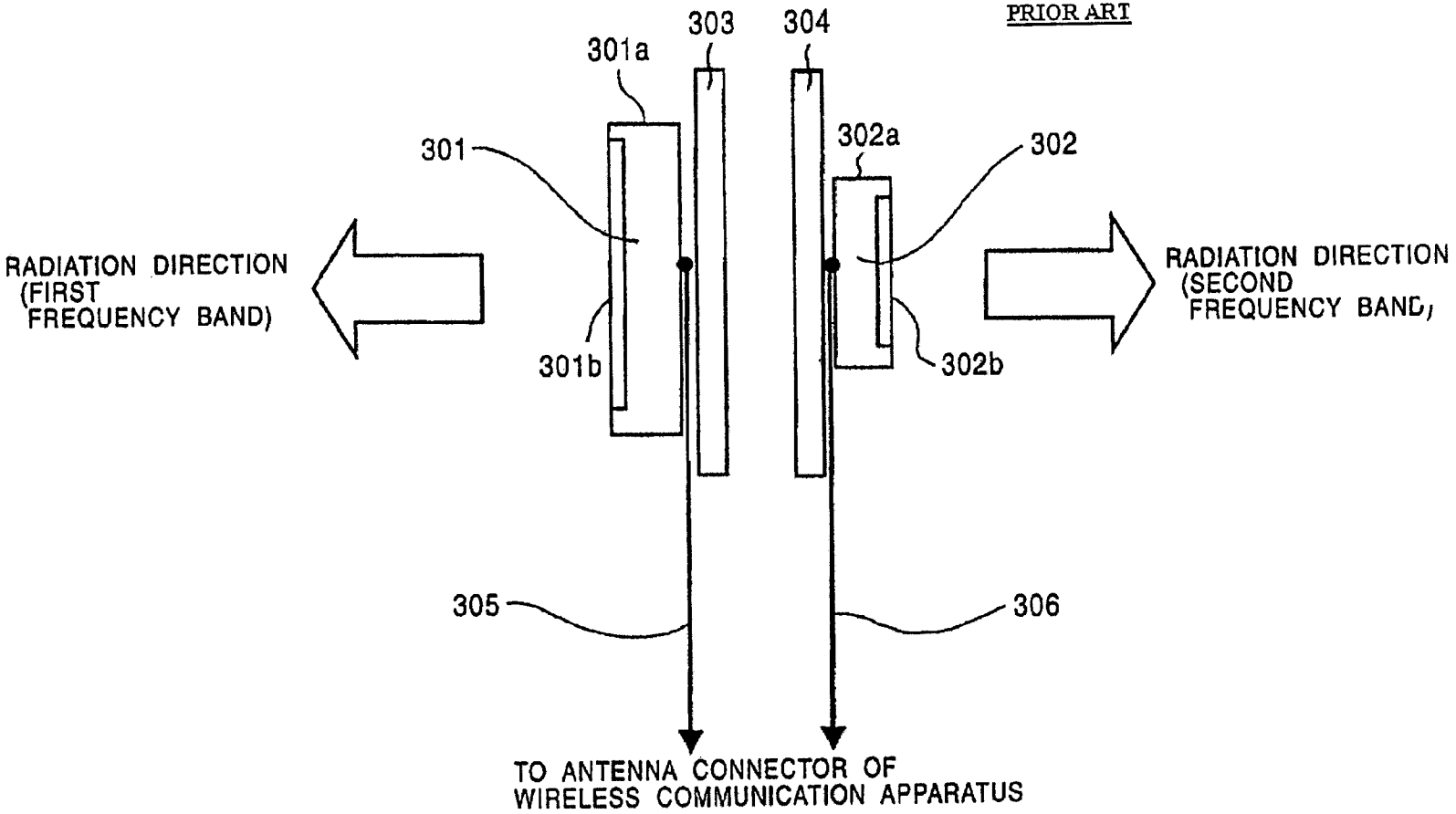
FIG. 3 PRIOR ART
FIG. 3 illustrates a known dual-band circularly polarized antenna apparatus.

FIG. 2 is a side view of an antenna apparatus according to a second embodiment of the present invention. In this embodiment, each of two circularly polarized antennas is provided with a coaxial cable.

Similarly to the first embodiment shown in FIG. 1, a circularly polarized antenna A 201 for a first frequency band and a circularly polarized antenna B 202 for a second frequency band are disposed back to back on the front and rear surfaces of a common substrate 203. In this embodiment, however, each of the circularly polarized antenna A 201 and the circularly polarized antenna B 202 is provided with a coaxial cable 204 and a coaxial cable 205, respectively. The detailed descriptions of each component will be omitted here, as they are similar to those in the first embodiment (FIG. 1) described above.

Although two coaxial cables are required in this embodiment, the removal of a frequency synthesizer simplifies the structure of the antenna apparatus. Furthermore, similarly to the first embodiment, the size of the wireless communication unit is reduced since the circularly polarized antennas A 201 and B 202 are disposed on the same substrate 203.

The details of the antenna apparatuses according to the above-described embodiments will now be described.

Figure 4:
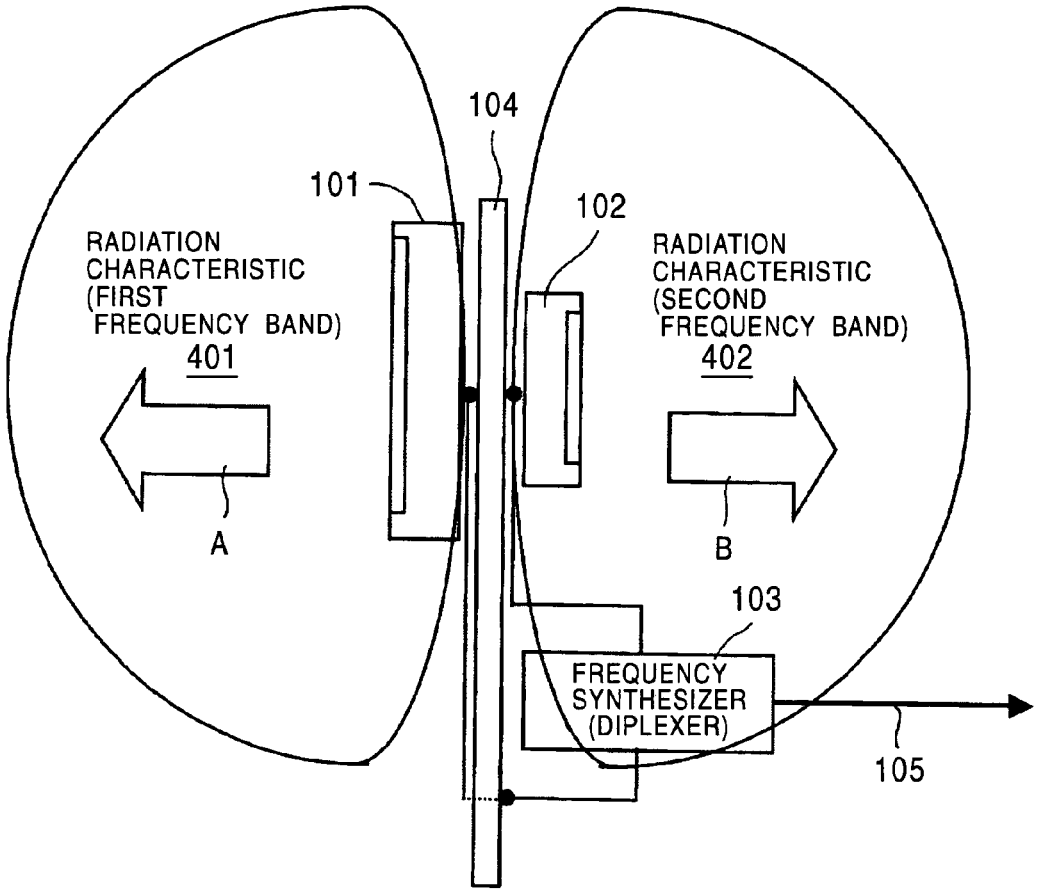
FIG. 4 is a schematic diagram showing radiation characteristics of the antenna apparatuses in FIGS. 1 and 2.

FIG. 4 illustrates radiation characteristics of each circularly polarized antenna of the antenna apparatus in FIG. 1.

As shown, the circularly polarized antennas A 101 and B 102 have hemispherical radiation characteristics 401 and 402 with different frequency bands. Radiation directions A and B of the circularly polarized antennas A 101 and B 102, respectively, are opposite one another.

Figure 5:
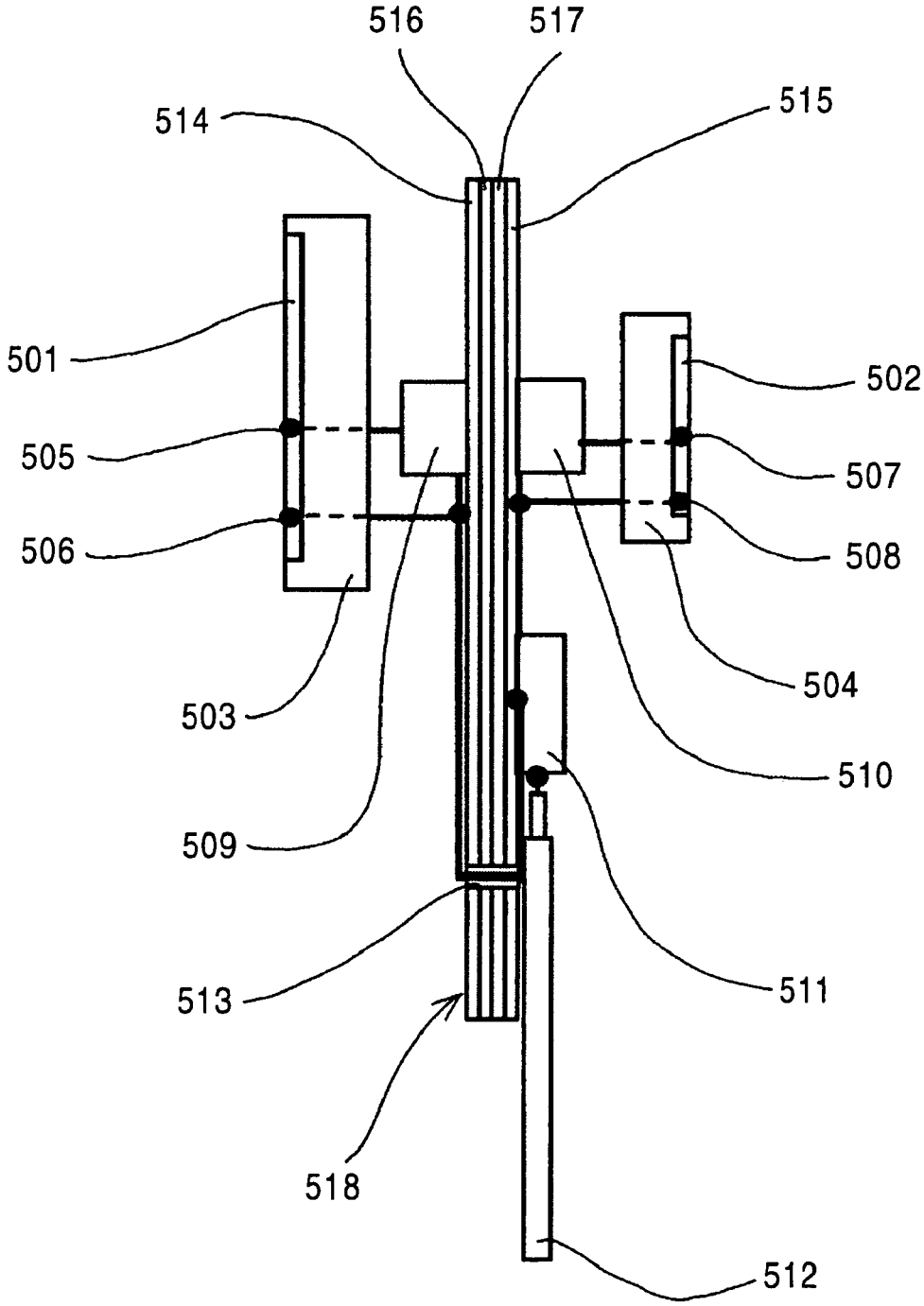
FIG. 5 is a sectional side view showing details of the dual-band circularly polarized antenna apparatus in FIG. 1.

FIG. 5 is a cross-sectional view showing the arrangement of the circularly polarized antennas and the substrate that are included in the antenna apparatus illustrated in FIG. 1.

Figure 6B:
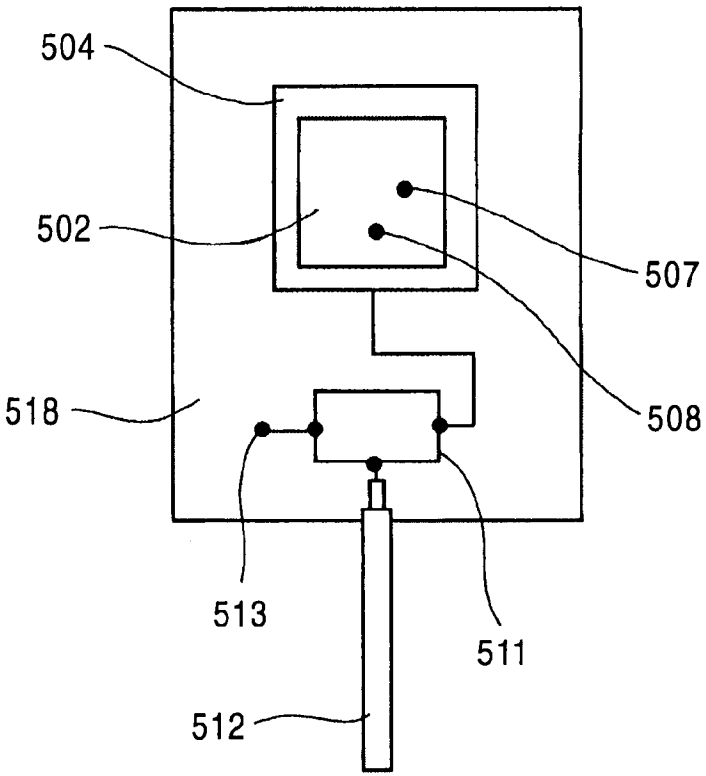
FIGS. 6A and 6B are a front view and a rear view, respectively, of the dual-band circularly polarized antenna apparatus in FIG. 1.
Figure 6A:
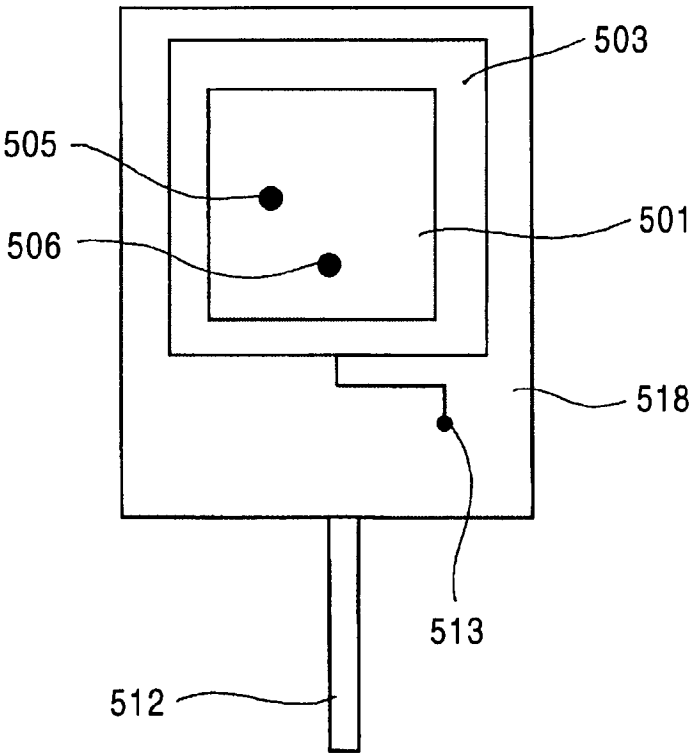

FIGS. 6A and 6B are external views of the antenna apparatus in FIG. 5. FIG. 6A shows the first circularly polarized antenna A side, and FIG. 6B shows the second circularly polarized antenna B side.

Referring to FIG. 5, a four-layer substrate 518 is used here. The substrate 518 includes two ground layers A 516 and B 517 that are interposed between conductive pattern layers A 514 and B 517, each having a wiring pattern.

A frequency synthesizer (diplexer) 511 leading to a coaxial cable 512 is connected to a 90-degree phase shifter A 509 and a 90-degree phase shifter B 510 that are adjacent to a flat antenna A 501 and a flat antenna B 502, respectively.

The flat antenna A 501 disposed on a dielectric plate A 503 is fed from feeding points A 505 and B 506, and radiates circularly polarized waves.

Similarly, the flat antenna B 502 is fed from feeding points C 507 and D 508, and radiates circularly polarized waves.

The 90-degree phase shifter A 509 is connected via a through hole 513 to the frequency synthesizer (diplexer) 511.

In each circularly polarized antenna of the first embodiment, the square shape of the flat antenna and a 90-degree phase shift between the two feeding points, which is provided by the 90-degree phase shifter, allow the circularly polarized waves to be radiated.

Further, the size of the flat antenna can be reduced, since wavelengths are reduced in the dielectric plate by disposing the flat antenna on the dielectric plate.

The frequency synthesizer (diplexer) 511 is provided on the side of the second frequency band (the second circularly polarized antenna B) that is higher than the first frequency band (the first circularly polarized antenna A). The reasons include high space efficiency and less degradation of signals, that is, when transmitting signals via a though hole, low frequency signals suffer less degradation compared to that suffered by high frequency signals.

Figure 7B:
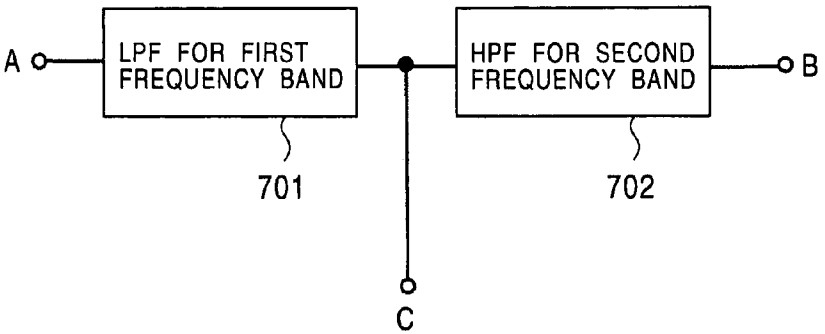
FIGS. 7A, 7B, and 7C illustrate the structures (FIGS. 7A and 7B) and characteristics (FIG. 7C) of a frequency synthesizer (diplexer) incorporated in the dual-band circularly polarized antenna apparatus in FIG. 1.
Figure 7C:
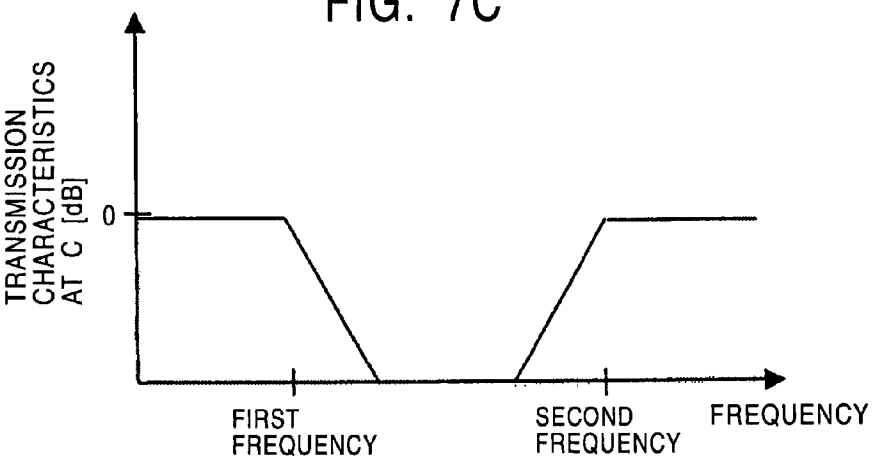
Figure 7A:
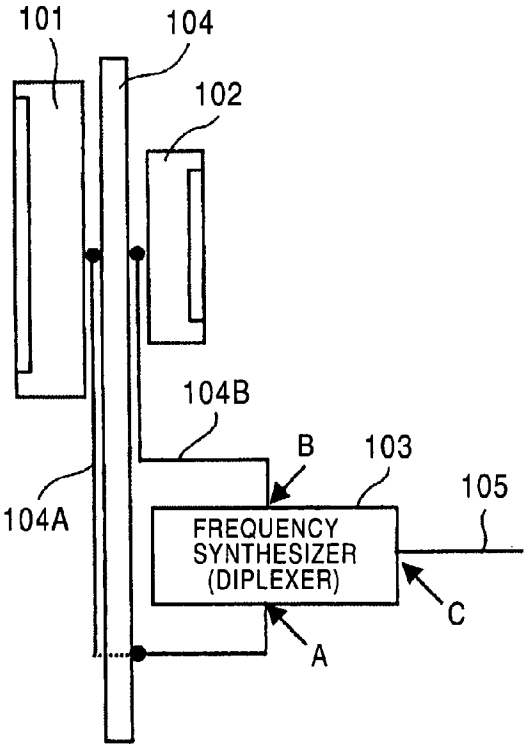

FIGS. 7A, 7B, and 7C illustrate the structures and characteristics of the frequency synthesizer (diplexer) according to the first embodiment.

As shown in FIGS. 7A and 7B, the frequency synthesizer 103 is formed of a low pass filter (LPF) 701 for the first frequency band and a high pass filter (HPF) 702 for the second frequency band. A terminal A of the LPF 701 and a terminal B of the HPF 702 are connected to the circularly polarized antenna A 101 and the circularly polarized antenna B 102, respectively. A terminal C that is common to both the LPF 701 and the HPF 702 is connected to the coaxial cable 105.

As shown in FIG. 7C, different frequency signals, that is, the first frequency signals and the second frequency signals are transmitted.

Figure 8:
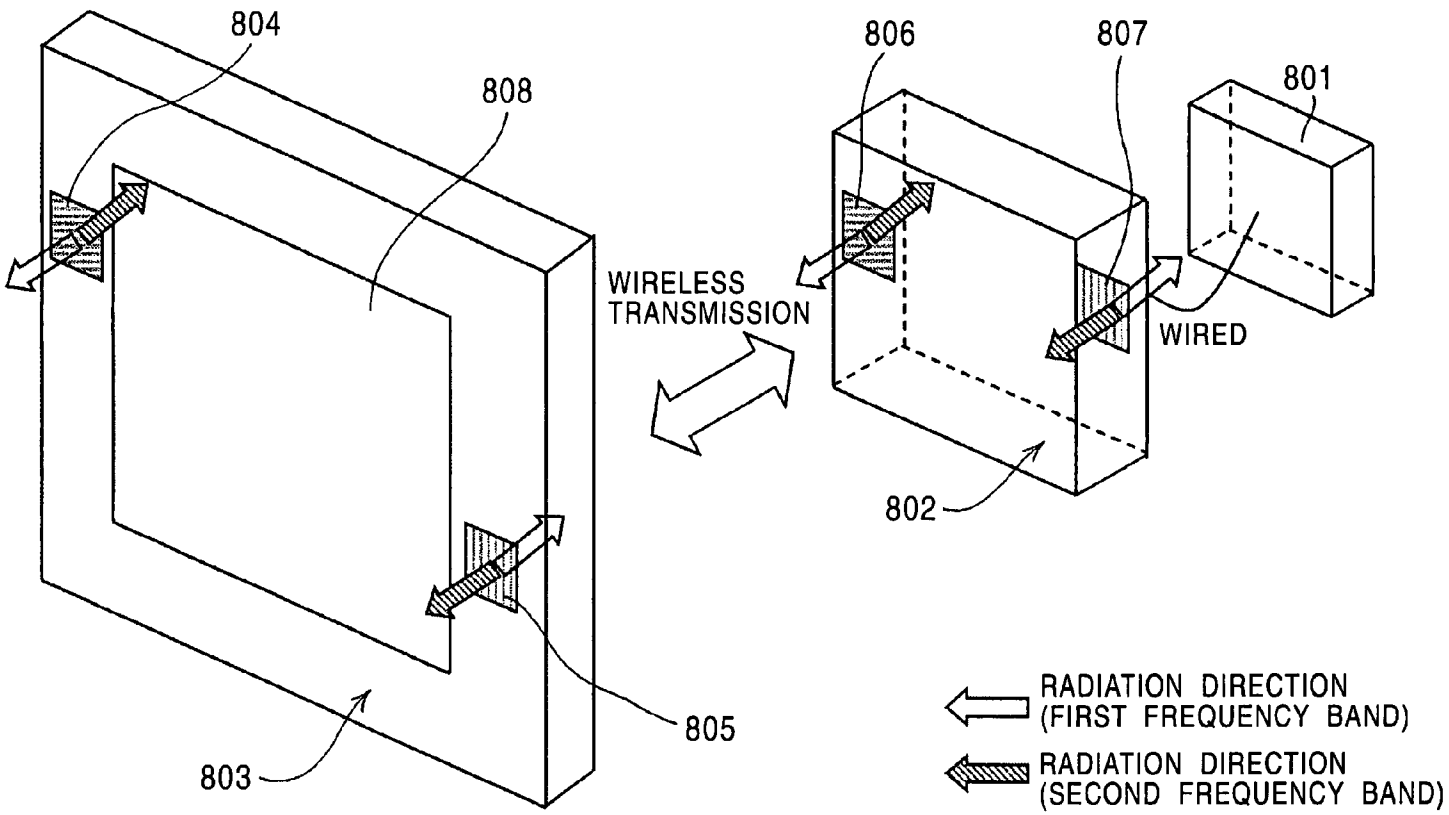
FIG. 8 is a perspective view showing an example of a wireless communication system incorporating the dual-band circularly polarized antenna apparatuses in FIG. 1.
Figure 9:
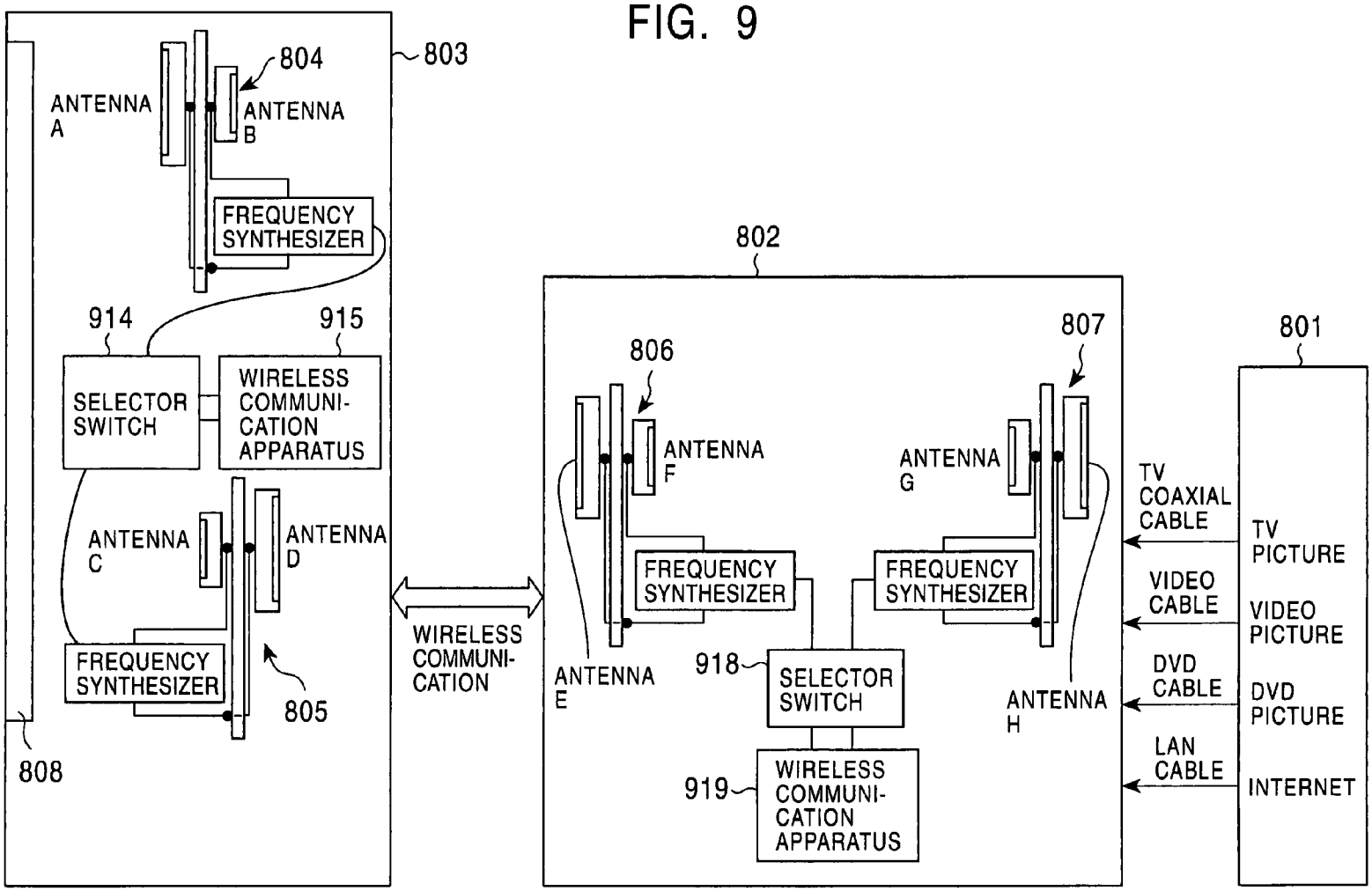
FIG. 9 is a block diagram showing circuitry of the wireless communication system in FIG. 8.

FIG. 8 shows an example of wireless communication systems incorporating the dual-band circularly polarized antenna apparatus according to the first embodiment. FIG. 9 is a block diagram showing the inner structure of the wireless communication system shown in FIG. 8.

Referring to FIG. 8, data of a source unit 801 is transmitted from a base unit 802 to a portable unit 803 by wireless transmission. The data of the source unit 801 is thus viewed on a liquid crystal display 808 of the portable unit 803.

Since one circularly polarized antenna has a hemispherical radiation pattern, two circularly polarized antennas are required for implementing antenna diversity to spherically transmit signals in wireless transmission.

Therefore, each of the portable unit 803 and the base unit 802 is provided with the two dual-band antenna apparatuses of this embodiment, the two apparatuses, each having two circularly polarized antennas for two different frequencies and being disposed back to back.

In the portable unit 803, two dual-band circularly polarized antenna apparatuses 804 and 805 are disposed in the opposite direction to form a spherical radiation pattern of each of two frequency bands. Similarly, in the base unit 802, two dual-band circularly polarized antenna apparatuses 806 and 807 are disposed in the opposite direction to form a spherical radiation pattern of each of two frequency bands.

Radiation patterns of two different frequency bands that are opposite in direction thus form a spherical radiation pattern.

Referring to FIG. 9, the source unit 801 is a supply source for supplying various types of image data. Examples of the source unit 801 include equipment for handling pictures of TV., video, and digital versatile disc (DVD), and networks such as the Internet. The source unit 801 supplies the image data to the base unit 802 via wires.

The portable unit 803 has a selector switch 914 and a wireless communication apparatus 915, and the base unit 802 similarly has a selector switch 918 and a wireless communication apparatus 919. The selector switches 914 and 918 select the most suitable antennas depending on the locations of the portable unit 803 and the base unit 802, and the radio wave conditions such as the presence of interference. The wireless communication apparatuses 915 and 919 are capable of sending and receiving data in the first and second frequency bands via wireless transmission. Each of the wireless communication apparatuses 915 and 919 is connected to two dual-band circularly polarized antenna apparatuses. That is, the wireless apparatus 915 is connected to the dual-band circularly polarized antenna apparatuses 804 and 805, and the wireless apparatus 919 is connected to the dual-band circularly polarized antenna apparatuses 806 and 807.

Although the circularly polarized antenna apparatus shown in FIG. 1 is adopted in the wireless communication system in FIG. 9, it may be replaced with the antenna apparatus shown in FIG. 2.

Figure 10:
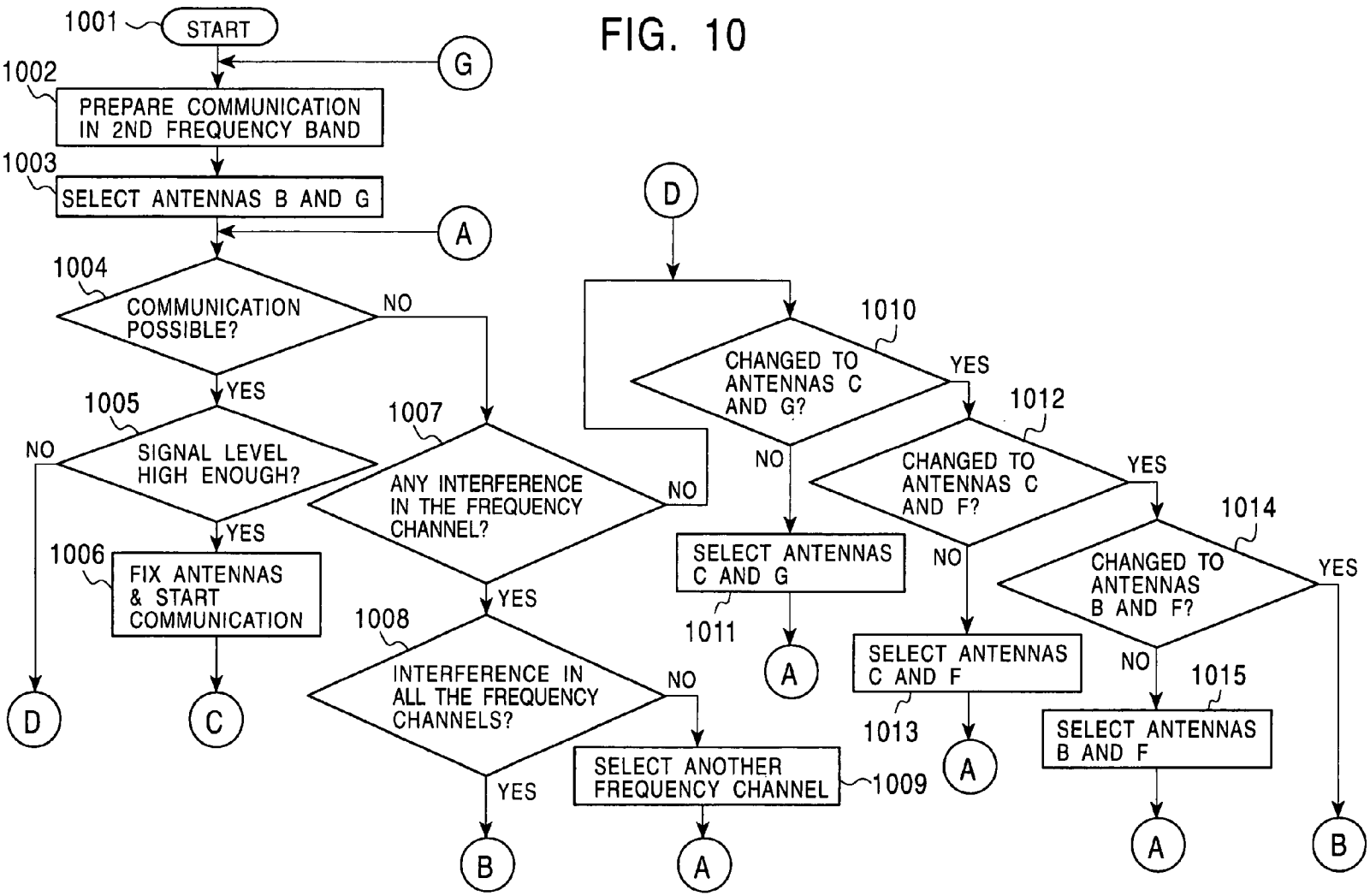
FIG. 10 is a flowchart showing the operation of the wireless communication system in FIG. 8.
Figure 11:
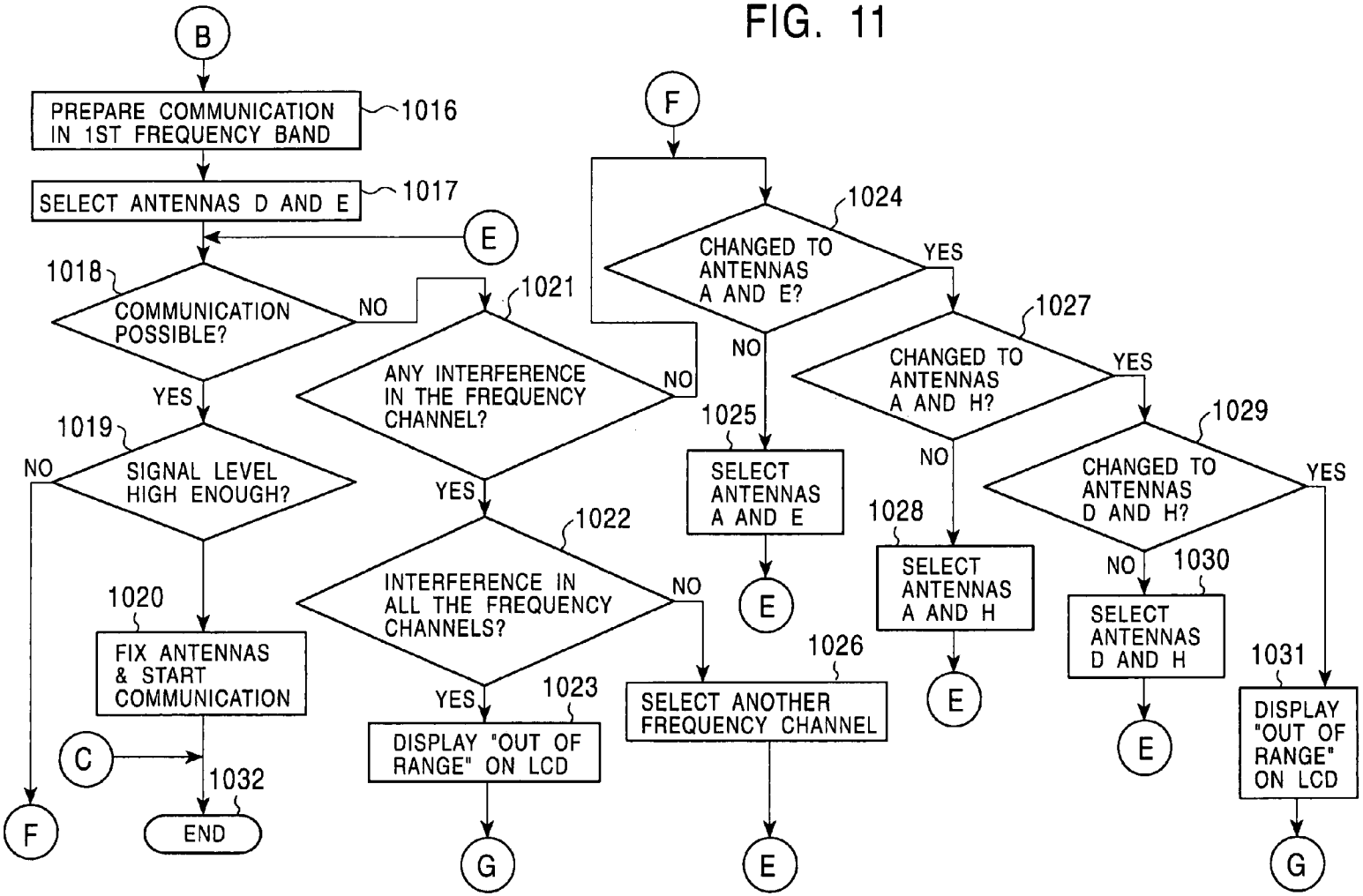
FIG. 11 is a flowchart showing the operation of the wireless communication system in FIG. 8.

FIGS. 10 and 11 are flowcharts showing the steps of selecting antennas in the wireless communication systems illustrated in FIGS. 8 and 9. The following descriptions refer to the positions of antennas A to H shown in FIG. 9.

First, the operation starts (1001) and communication in the second frequency band is prepared (1002). Here, the second frequency band is selected as the initial setting because of its higher throughput and less interference compared to that in the first frequency band.

As the initial settings of antennas, moreover, the selector switch 914 of the portable unit 803 selects the rear antenna (antenna B), and the selector switch 918 of the base unit 802 selects the front antenna (antenna G) (1003).

The next step determines whether communication between the portable unit 803 and the base unit 802 is possible (1004), and when possible, determines whether the signal level is high enough (1005). Further, when the signal level is high enough, the antennas are fixed and communication starts (1006).

When the signal level is not high enough, other combinations of antennas in the portable unit 803 and the base unit 802 are examined. When an antenna combination with a high signal level is found, the antennas are fixed and communication starts (1010–1015).

When no antenna combination with a high signal level is found, communication between the portable unit 803 and the base unit 802 is assumed to be impossible due to the distance therebetween. Then communication in the first frequency band, where attenuation of radio waves tends not to occur, is prepared (1016).

Referring back to 1004, when communication is impossible in the second frequency band, presence of interference in the frequency channel is examined (1007).

When no interference occurs in the frequency channel, other combinations of antennas in the portable unit 803 and the base unit 802 are examined (1010–1015).

When interference occurs in the frequency channel, presence of interference in all the frequency channels in the second frequency band is examined (1008).

When interference occurs in all the frequency channels, communication in the first frequency band is prepared (1016). As the initial setting of the antennas in the first frequency band, the selector switch 914 of the portable unit 803 selects the rear antenna (antenna D), and the selector switch 918 of the base unit 802 selects the front antenna (antenna E) (1017). After the procedure similar to that in the second frequency band, antennas are fixed and communication starts (1018–1020, 1024–1030).

When interference occurs in all the frequency channels in the first frequency band (1022), an "out of range" message is displayed on the liquid crystal display (1023) and communication in the second frequency band is prepared (1002).

When no interference occurs in the channel in the first frequency band (1021), and when no combination of antennas in the portable unit 803 and the base unit 802 with a high signal level is found, the portable unit 803 and the base unit 802 are assumed to be distant, an "out of range" message is displayed on the liquid crystal display (1031), and communication in the second frequency band is prepared (1002).

In the above embodiments, the antenna apparatus of the present invention is applied to a diversity-antenna wireless communication system. The present invention is not limited to the embodiments shown, but is widely applied to dual-band antenna apparatuses in various types of wireless communication systems.

While effective, application of the circularly polarized antenna apparatus of the present invention is not limited to 2.4 and 5.2 GHz wireless LAN systems.

What is claimed is:

1. An antenna apparatus comprising:

a first circularly polarized antenna that efficiently sends and/or receives high-frequency signals in a first frequency band, the antenna having a substantially hemispherical radiation pattern;

a second circularly polarized antenna that efficiently sends and/or receives high-frequency signals in a second frequency band higher than the first frequency band, the antenna having a substantially hemispherical radiation pattern; and a single substrate, the first circularly polarized antenna and the second circularly polarized antenna being disposed on the front and rear surfaces, respectively, of the substrate, the radiation patterns of these two antennas thereby being opposite in direction.

2. The antenna apparatus according to claim 1, further comprising two wiring patterns, one being connected to the first circularly polarized antenna on the front surface of the substrate, the other being connected to the second circularly polarized antenna on the rear surface of the substrate.

3. The antenna apparatus according to claim 2, further comprising at least one coaxial cable, the first circularly polarized antenna and the second circularly polarized antenna being connected via the wiring patterns and the coaxial cable, to a communication apparatus.

4. The antenna apparatus according to claim 2, further comprising a frequency synthesizer that is connected, via the wiring patterns, to the first circularly polarized antenna and the second circularly polarized antenna, the frequency synthesizer being common to both the antennas.

5. The antenna apparatus according to claim 4, wherein the first circularly polarized antenna and the second circularly polarized antenna are connected via the frequency synthesizer to the common coaxial cable that is connected to the communication apparatus.

6. The antenna apparatus according to claim 4, wherein the frequency synthesizer is disposed on one surface of the substrate, the wiring pattern on the other surface is guided via a through hole of the substrate to the surface where the frequency synthesizer is disposed, and is connected to the frequency synthesizer.

7. The antenna apparatus according to claim 6, wherein the frequency synthesizer is disposed on the surface of the substrate, the surface on which the second circularly polarized antenna is disposed.

* * * * *